US011559150B2

(12) United States Patent
Spiro et al.

(10) Patent No.: US 11,559,150 B2
(45) Date of Patent: Jan. 24, 2023

(54) CUBE-SHAPED ORNAMENT AND PHOTO DISPLAY

(71) Applicant: Tracer Imaging LLC, Ossining, NY (US)

(72) Inventors: Steven M. Spiro, Chappaqua, NY (US); Ryan Kelly, Scarsdale, NY (US)

(73) Assignee: TRACER IMAGING LLC, Ossining, NY (US)

( * ) Notice: Subject to any disclaimer, the term of this patent is extended or adjusted under 35 U.S.C. 154(b) by 0 days.

(21) Appl. No.: 17/462,578

(22) Filed: Aug. 31, 2021

(65) Prior Publication Data

US 2022/0061555 A1 Mar. 3, 2022

Related U.S. Application Data

(60) Provisional application No. 63/073,112, filed on Sep. 1, 2020.

(51) Int. Cl.
*A47G 1/06* (2006.01)

(52) U.S. Cl.
CPC ..... *A47G 1/065* (2013.01); *A47G 2001/0677* (2013.01); *A47G 2001/0694* (2013.01)

(58) Field of Classification Search
CPC ..... A47G 1/065; A47G 2001/0677; A47G 2001/0694; A47G 2001/145
See application file for complete search history.

(56) References Cited

U.S. PATENT DOCUMENTS 3,703,045 A * 11/1972 Nyman ..... A47G 1/14 40/737
3,716,936 A * 2/1973 Miller ..... A47G 1/14 40/721
3,771,246 A * 11/1973 Ebner ..... A47G 1/14 40/728
4,195,729 A 4/1980 Macken
4,989,120 A * 1/1991 Davis ..... F21S 4/10 362/124
5,309,657 A * 5/1994 Spencer ..... G09F 1/12 40/473
5,505,132 A * 4/1996 Warren ..... B41K 1/006 101/28
5,630,512 A * 5/1997 Wells ..... G09F 23/00 206/782
6,792,709 B1 9/2004 Fine
2002/0100199 A1* 8/2002 Bean ..... A47G 1/141 40/720

(Continued)

*Primary Examiner* — Gary C Hoge
(74) *Attorney, Agent, or Firm* — Leason Ellis LLP

(57) ABSTRACT

A cube-shaped display article includes an inner cube-shaped base and a first image substrate that is formed of a plurality of individual image receiving sections that are arranged in a first pattern, such as a cross shape. The first image substrate having a plurality of crease lines to permit folding of the individual image receiving sections of the first image substrate for positioning the individual image sections against corresponding faces of the inner cube-shaped base. An outer hollow cube-shaped cage for placement over the inner cube-shaped base. The outer hollow cube-shaped cage captures the first image substrate which is located between the outer hollow cube-shaped cage and the inner cube-shaped base and serves to press the individual images against the corresponding faces of the inner cube-shaped base.

20 Claims, 12 Drawing Sheets

(56) References Cited

U.S. PATENT DOCUMENTS

| | | | | |
|---|---|---|---|---|
| 2002/0124451 | A1* | 9/2002 | Ong | A47G 1/14<br>40/714 |
| 2002/0133994 | A1* | 9/2002 | Vincent | A47G 1/14<br>40/777 |
| 2003/0192219 | A1* | 10/2003 | Vincent | A47G 1/14<br>40/611.01 |
| 2003/0193488 | A1 | 10/2003 | Bean | |
| 2010/0162603 | A1 | 7/2010 | Cruz | |
| 2018/0213950 | A1* | 8/2018 | Millman | A47G 1/17 |
| 2021/0120982 | A1* | 4/2021 | Spiro | A47G 1/14 |

* cited by examiner

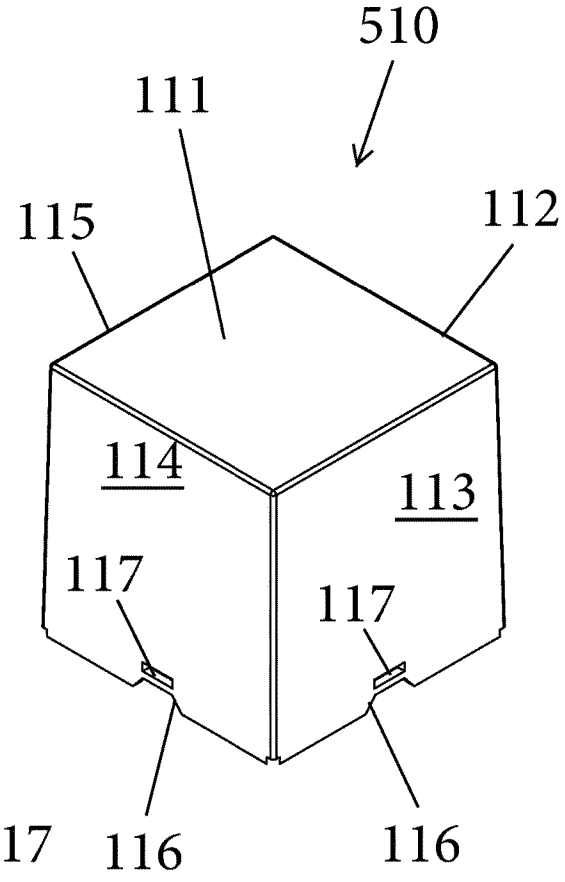
Fig. 22
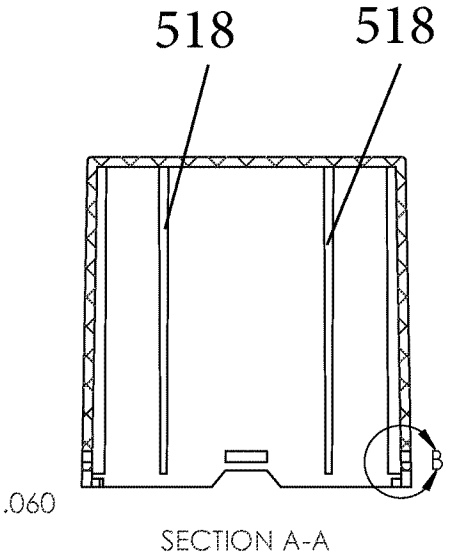
Fig. 24
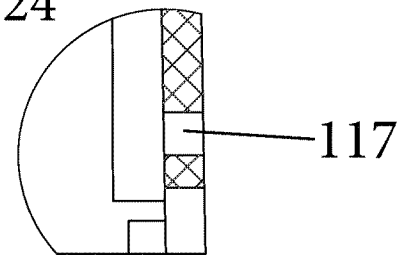
Fig. 25
Fig. 23
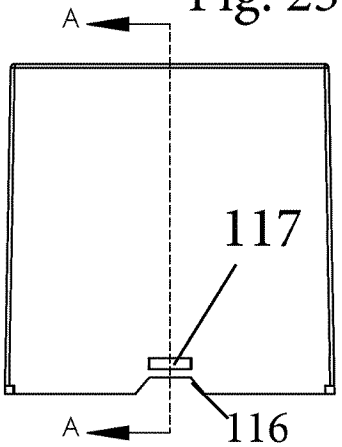
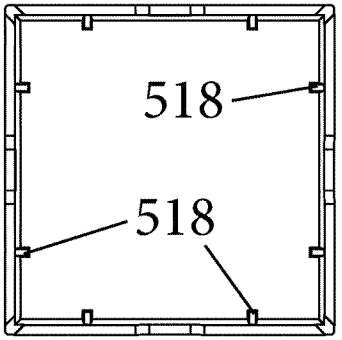
Fig. 26

CUBE-SHAPED ORNAMENT AND PHOTO DISPLAY

CROSS REFERENCE TO RELATED APPLICATION

The present application claims priority to and the benefit of U.S. patent application Ser. No. 63/073,112, filed Sep. 1, 2020, which is hereby incorporated by reference in its entirety.

TECHNICAL FIELD

The present application is directed to display articles and more particularly, to a cube-shaped display article that is configured to display printed matter, such as photographs, and also is configured to act as an ornament that can be hung.

BACKGROUND

Display articles come in many different shapes and sizes and constructions depending upon the nature of the articles to be displayed.

One type of display article that is often used to display plural photographs is a cube display since a cube is a six-sided object which allows for one photo to be displayed on one selected cube side (face). Thus, a photo cube allows a person to display up to six photos or a combination of photos and other objects, such as artwork or sayings, can be placed on some of the sides of the cube. Traditional photo cubes can be formed of plastic materials and some are designed to also store photos in the hollow center. While commercially available photo cubes are functional, there is a need for an improved photo cube that can be easily assembled by the user and is designed to securely hold the photos or other printed matter, etc.

In addition to photo displays, ornaments are another type of display article. As is known, an ornament is an accessory, article, or detail used to beautify the appearance of something to which it is added or of which it is a part. There are many different types of ornament ranging from architectural ornaments to decorative ornaments that are intended to be hung from an object, such as a window or other support structure or a branch of a holiday tree. During holiday time, personalized ornaments are often given as gifts.

SUMMARY

In one embodiment, a cube-shaped display article includes an inner cube-shaped base and a first image substrate that is formed of a plurality of individual image receiving sections that are arranged in a first pattern, such as a cross shape. The first image substrate having a plurality of crease lines to permit folding of the individual image receiving sections of the first image substrate for positioning the individual image sections against corresponding faces of the inner cube-shaped base.

The cube-shaped display article also includes an outer hollow cube-shaped cage for placement over the inner cube-shaped base. The outer hollow cube-shaped cage captures the first image substrate which is located between the outer hollow cube-shaped cage and the inner cube-shaped base and serves to press the individual images against the corresponding faces of the inner cube-shaped base.

In another aspect, the present disclosure is directed to a method for constructing a cube-shaped display article comprising the steps of:

disposing a first image substrate over an inner cube-shaped base, the first image substrate comprising a plurality of individual image sections that are arranged in a first pattern and on which an image can be formed, the first image substrate having a plurality of crease lines;

folding the first image substrate about the crease lines to position the individual images against corresponding faces of the inner cube-shaped base; and sliding an outer hollow cube-shaped cage over both the folded first image substrate and the inner cube-shaped base resulting in the capturing of the first image substrate between the outer hollow cube-shaped cage and the inner cube-shaped base and resulting in the individual images being pressed against the corresponding faces of the inner cube-shaped base.

BRIEF DESCRIPTION OF THE DRAWING FIGURES

FIG. 22 is a perspective view of a base of the cube-shaped display article of FIG. 21;

FIG. 23 is a side elevation view thereof;

FIG. 24 is a cross-sectional view taken along the line A-A of FIG. 23;

FIG. 25 is an enlarged portion of the base;

FIG. 26 is a bottom plan view;

DETAILED DESCRIPTION OF CERTAIN EMBODIMENTS

FIGS. 1-20 illustrate a display article 100 in accordance with a first embodiment of the present disclosure. As shown, the display article 100 is in the form of a cube-shaped article that is configured to display a plurality of images, such as photographs, artwork, text (saying), along a plurality of sides of the cube-shaped display article 100. Unlike plastic molded photo cubes that are on the market, the display article 100 is configured so that a product assembly facility, such as a photo department of a retail store, or a user, such as an end consumer, can easily both produce the images to be displayed and also assembly the display article 100.

Figure 20:
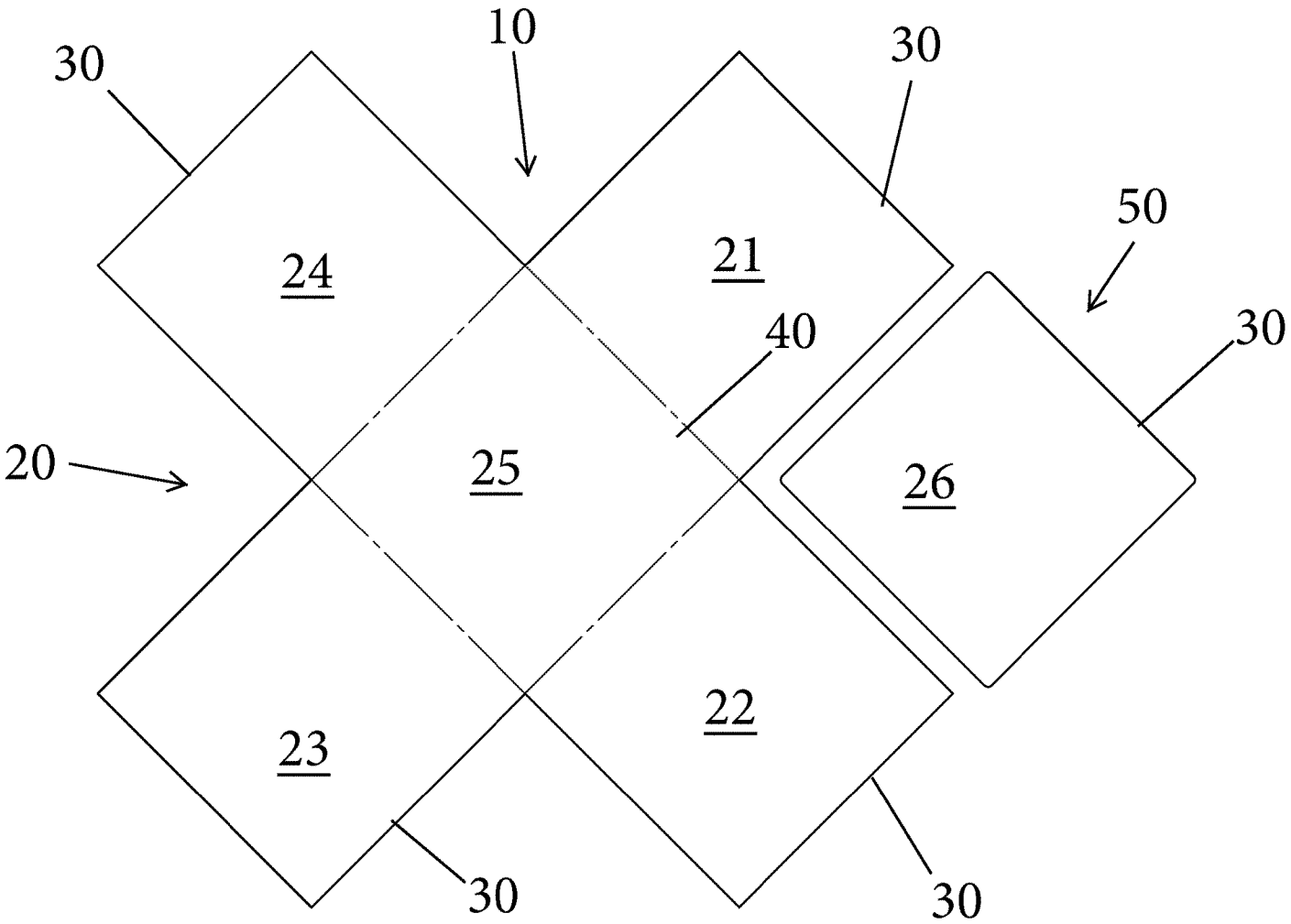
FIG. 20 illustrates a template of the display stock for use with the cube-shaped display article of FIG. 1.
Figure 21:
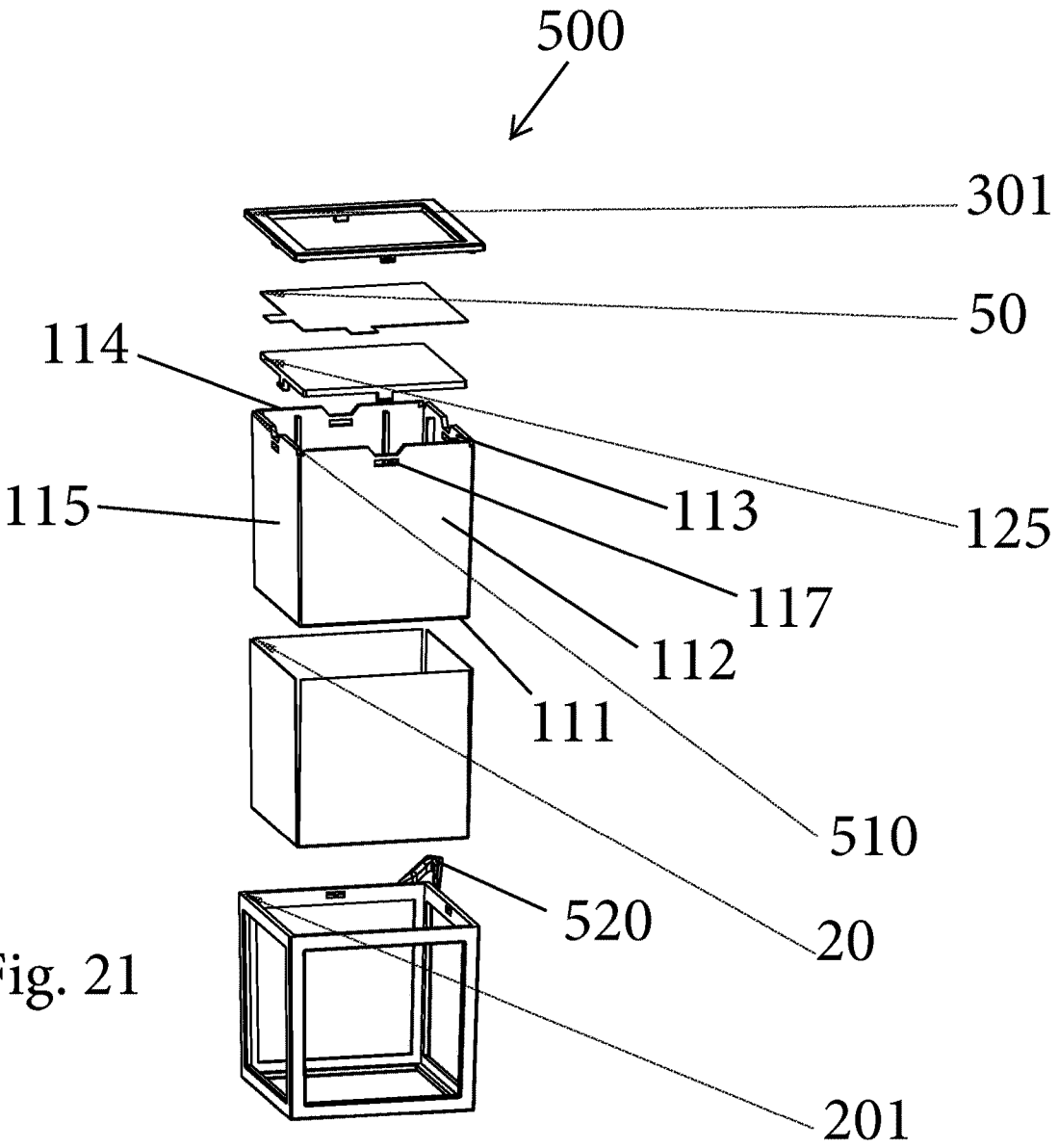
FIG. 21 is an exploded perspective view of a cube-shaped display article in accordance with a second embodiment.

Template 10 (FIG. 20)

Figure 1:
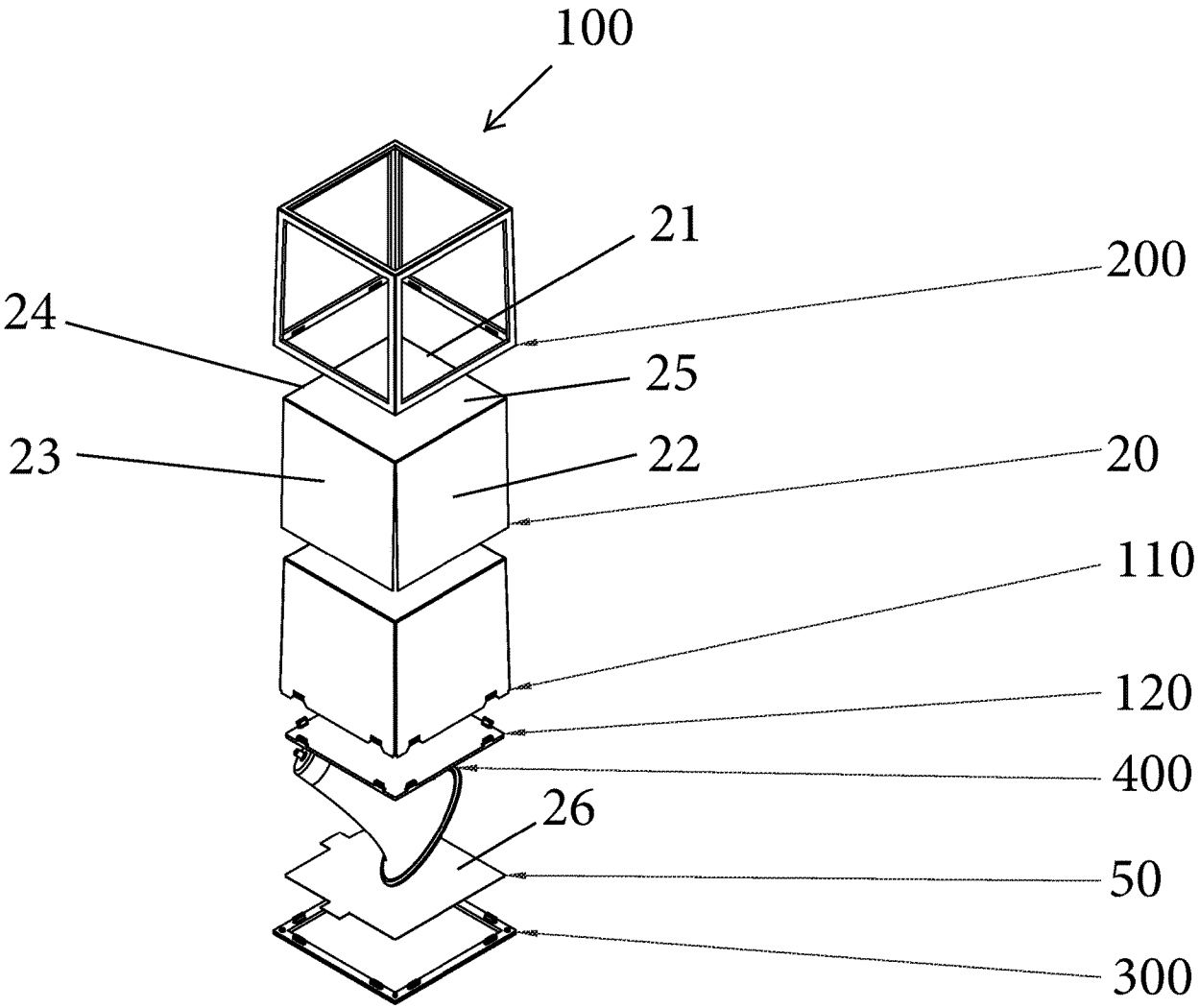
FIG. 1 is an exploded perspective view of a cube-shaped display article in accordance with a first embodiment.

As shown in FIG. 1, the display article 100 is formed of a plurality parts that are assembled together. In most traditional photo cubes, the photos are separate individual photos formed on photograph stock (paper) that are individually located and displayed on one side of the photo cube. Traditionally, each photo is adhered to the cube base as by using an adhesive, like glue. The present display article 100 is different in that the images to be displayed are not formed on separate individual stock but rather, as shown in FIG. 20, a template 10 is used and contains 5 images in a single substrate that can be positioned along corresponding five sides of the display article 100 as discussed below. The template 10 can be formed of a label stock of a selected size, such as 8.5×11 inch. As is known, label stock is traditionally formed of face stock which is the layer that the user sees and touches and more specifically, is the layer that a machine prints on, and is configured to stick to a desired surface through the adhesive (glue) on the back surface (back face). The glue holds the face stock to a liner. The liner serves as a carrier that carries the face stock. The liner can be formed of any number of suitable materials, including but not limited to, paper or polyester. The liner is viewed as throw-away material.

The label stock that forms the template 10 is specifically fabricated to have the shape and format shown in FIG. 20. In particular, the template has a removable first label section (first image substrate) 20 that takes a cross shaped form due to purposefully positioned die cuts 30 and perforated cuts 40. The die cuts 30 (shown in solid lines in FIG. 20) define the cross shaped outline of the first label section 20. The first label section 20 is thus a single continuous structure having a cross shape. The first label section 20 also has four perforated cuts 40 arranged in an inner square shape. Each of the perforated cuts 40 defines a fold line (i.e., the first label section 20 is thus pre-creased). The first label section 20 thus includes a first image 21, a second image 22, a third image 23, a fourth image 24 and a fifth mage 25. As shown, the fifth image 25 represents a center image and the others extend around the fifth image 25. It will be appreciated the each of the images 21-25 is thus formed in an image receiving section that has its own borders.

The template 10 also includes a second label section (second image substrate) 50 that is in the form of a single image, namely, a sixth image 26. Both the first label section 20 and the second label section 50 are formed out of the same template. As shown, the second label section 50 is square shaped and defined by four die cuts 30.

It will be appreciated that any number of types of images can be formed on the first label section 20 and the second label section 50. For example, images can be printed on the label stock. The images can take the form of photos, artwork, text, or other decorative indicia. This arrangement provides for a high degree of customization since the user can select the precise images (e.g., photos) to be displayed and then insert the template 10 into a suitable printer that then prints the individual images on the label stock. Alternatively, the images can be formed on the label stock using other techniques. For example, in the case of artwork, the images can be applied by hand (e.g., hand painted onto the label stock). As described herein, after the template 10 is fabricated, the user then subsequently applies the first and second label sections 20, 50 to another base part of the assembly as described herein.

Cube-Shaped Display Article 100

As mentioned, the cube-shaped display article 100 is formed of a number of parts that are assembled together.

Base 120

For example, the cube-shaped display article 100 includes a base 110. The base 110 represents the structure to which the first label section 20 is applied. Accordingly, the base 110 is a five sided object that has fives faces 111, 112, 113, 114, 115 that have complementary shapes and sizes relative to the five images 21-25 to allow the five images 21-25 to be applied to five faces 111-115 of the base 110. In one embodiment, when the label stock (i.e., the first label section 20) is removed from the carrier, any adhesive residues is left behind on the carrier and the back side of the label stock is substantially free of adhesive. As a result, the first label section 20 is not adhesively bonded to the five faces 111-115 but rather the first label section 20 is merely positioned and disposed over the five faces 111-115 without a positive bonding or direct attachment between the two.

As shown in FIGS. 9-13, the base 110 is a hollow structure that is open along its sixth face. In the illustrated embodiment, the base 110 is square shape and thus, each of the five faces 111-115 has a square shape. However, it will be appreciated that the size and/or shape of the base 110 can be altered and still be within the scope of the present disclosure. The first face 111 of the base 110 can be thought of as being a top of the base 110, with the second to five faces 112-115 being the sides of the base 110. At the bottom edge of each of the second to five faces 112-115, there are a pair of notches 116 that are formed and open along the bottom edge. In addition, each of these faces 112-115 includes a pair of openings 117 that are located immediately above the notches 116. In the illustrated embodiment, the openings 117 are rectangular shaped, the while notch 116 is defined by angled side walls that taper inward toward the opening 117. It will be understood that the opening 117 and notch 116 can have other shapes as well. Since there are five faces 111-115, the base 110 has a total of ten notches 116 and ten openings 117.

As shown in FIGS. 9-13, the hollow inside of the base 110, there can be structural ribs (e.g., 4 ribs) 118 to provide for reinforcement of the base 110. There can be four ribs 118 with each rib 118 being connected between one respective side wall and the top wall that defines the first face 111. Inside the base 110 there is also a downwardly extending post 119 that can be located in the center of the base and more specifically is centrally located and attached to the underside of the top wall (first face 111) of the base 110. The post 119 can have at its distal end a hollow center.

The bottom corners of the base 110 also include corner guide cutouts or notches 105 formed in each bottom corner of the base 110. More specifically, along the bottom edge of each of the faces 112-115, the corner guide cutouts 105 are formed in corners of the base 110 where two of the faces 112-115 join. Like the notches 116, the corner guide cutouts 105 are open along the bottom edge of the faces 112-115.

Cap 120

Figure 14:
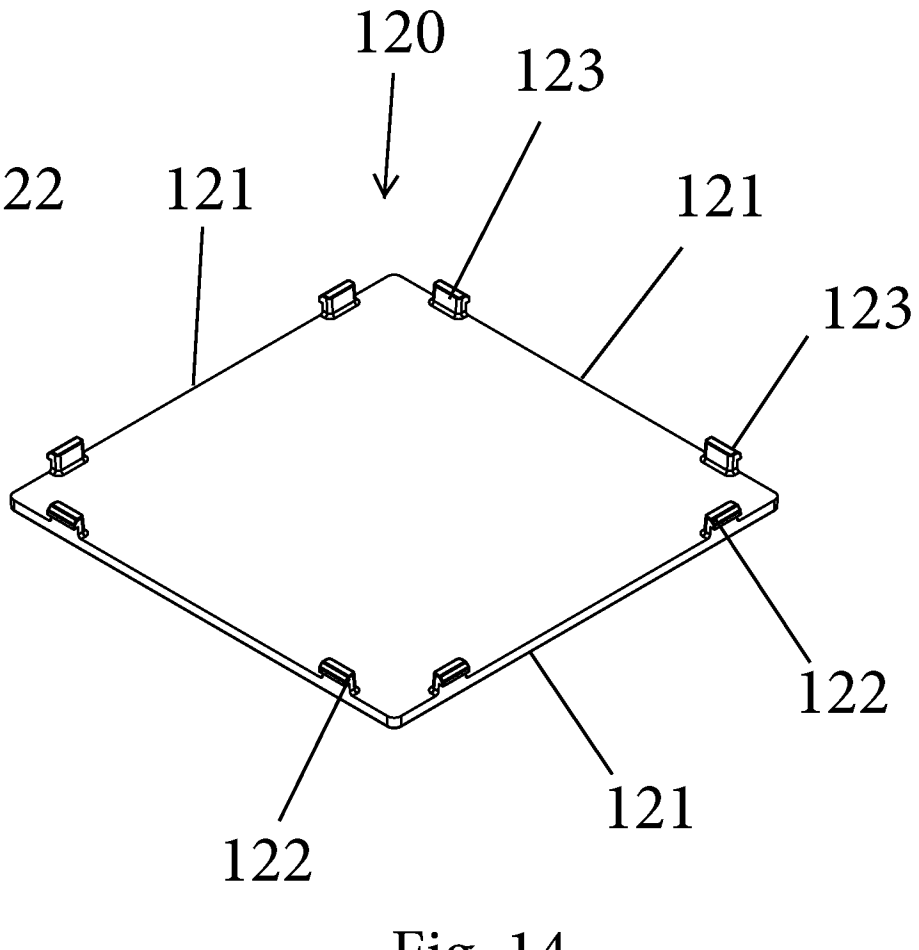
FIG. 14 is a bottom perspective view of a cap of the cube-shaped display article of FIG. 1.
Figure 15:
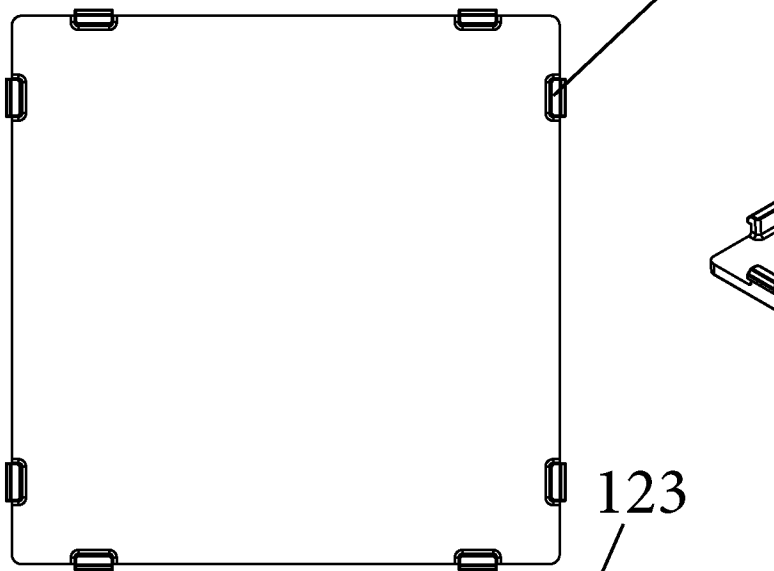
FIG. 15 is a bottom plan view.
Figure 16:
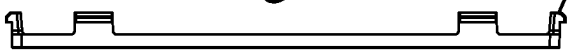
FIG. 16 is a side elevation view.

The cube-shaped display article 100 also includes a cap 120 that is configured to mate to the base 110 along the sixth face for completing and making the cube-shaped base 110 complete. In other words, the cap 120 is a wall plate that attaches to the open sixth face of the base 110 to close it off. As shown in FIGS. 14-16, the cap 120 has a plate structure that is complementary to the shape of the base 110 and therefore, in the illustrated embodiment, the cap 120 has a square shape and has four side wall edges generally shown at 121 (that define the four sides of the cap 120). Along each side edge 121, there is a pair of locking tabs 122. Each locking tab 122 is designed to mate with one respective opening 117 to attach the cap 120 to the base 110. Each locking tab 122 has an upstanding wall that extends from the plate and there is a top lip 123 that extends outwardly from the upstanding wall. It is the lip 123 that is received within the opening 117 to form a snap-fit between the cap 120 and the base 110. Once the cap 120 is attached to the base 110, the resulting structure is a complete cube with a hollow interior. This attachment is intended to be of a permanent nature.

It will be fully understood and appreciated that instead of having the base 110 and the separate cap 120, the two can be combined into a single cube-shaped structure, such as a hollow or solid block. For example, a solid block shaped structure (e.g., a wood block) can be used and provides the 6 faces on which the six images are displayed.

Positioning of the First and Second Label Sections 20, 50

As mentioned, the first label section 20 is intended for placement over the base 110 with the images 21-25 being disposed over the fives faces 111-115 of the base 110. The perforated cut lines 40 define fold (crease) lines of the first label section 20 to allow the images to be folded around the faces of the base 110. For example, the image 25 is placed against the first face 111 of the base 110 and then the images 21-24 are folded about the perforated cut lines 40 to allow the images 21-24 to be folded downward and positioned against the other respective faces 112-115.

It will be appreciated that the second label section 50 is for positioning along the outer face (sixth face) of the cap 120. It will also be appreciated that the use can choose not to use the second label section 50 since in normal operation, this represents the face of the cube that faces downward and would thus not be visible to the user.

Figure 2:
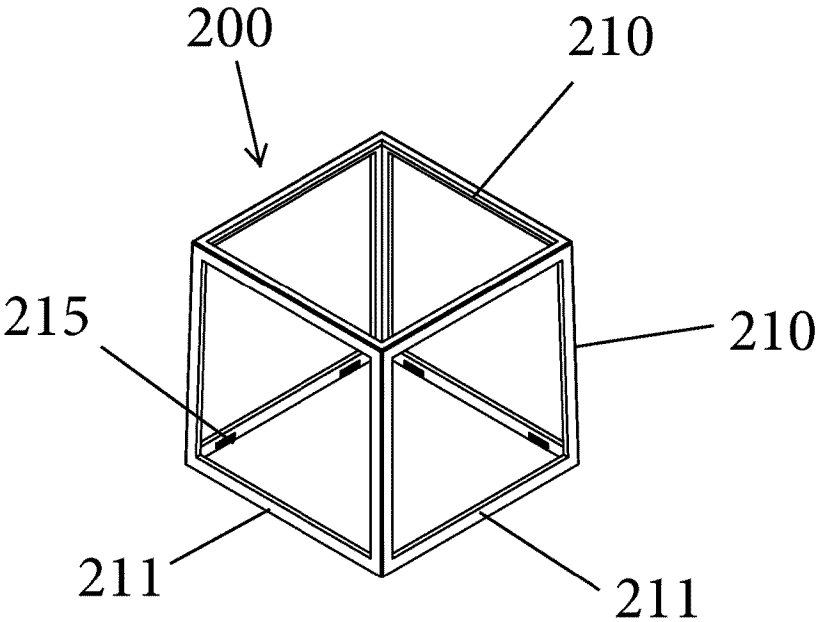
FIG. 2 is a perspective view of a cage of the cube-shaped display article of FIG. 1.
Figure 5:
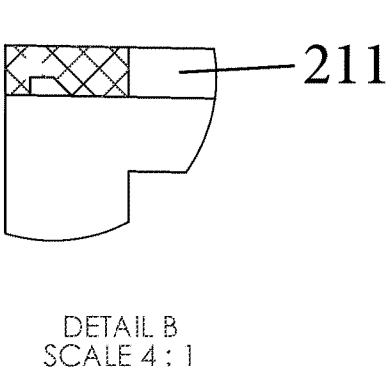
FIG. 5 is an enlarged corner portion of the cage.
Figure 4:
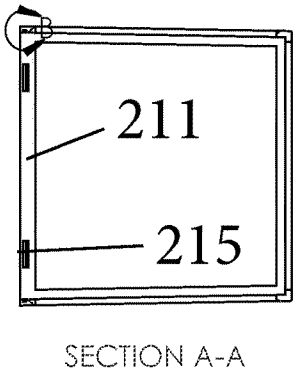
FIG. 4 is a cross-sectional view taken along the line A-A in FIG. 3.
Figure 3:
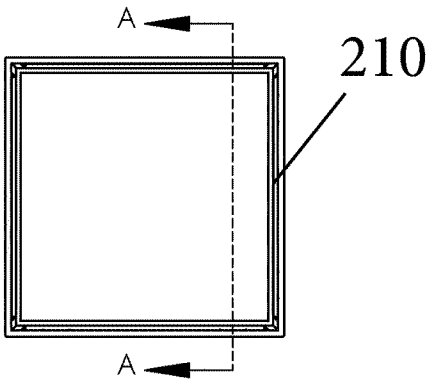
FIG. 3 is a top plan view thereof.

Cage 200 (FIG. 2)

The cube-shaped display article 100 includes a cage structure that completes the display article 100 and serves to retain the first and second label sections 20, 50 in place over the base 110 and the cap 120.

The cage 200 is in the form of a wire frame that has the outline of a cube and is defined by a plurality of rails 210 that are attached to one another at their ends. The inside of the cage 200 is completely hollow. The rails 210 are not all the like in that a bottom set of rails 211 includes locking features as described below. The other rails, including the side (vertical) rails and the top rails 210 do not include these locking features. The locking features that are formed in each of the bottom rails 211 comprises a pair of recesses 215 that are spaced apart from one another and generally located near the ends of the respective bottom rail 211. As shown, the recesses 215 face inward and are thus formed along the inner surface of the bottom rails 211 (facing into the hollow interior). With four bottom rails 211, there are thus a total of eight locking recesses 215.

The cage 200 is shaped and sized so that it can fit over the first label section 20 that is itself disposed over the base 110. In other words, the cage 200 acts as a retainer for the first label section 20 and, as discussed below, the user slowly guides the cage 200 over the first label section 20 and the base 110 causing the side images 21-24 (FIG. 20) to be pushed inward against the respective faces of the base 110. The purposeful tight fit between the outer cage 200 and the inner base 110 results in the first label section 20 being captured between the outer cage 200 and the inner base 110. Not only is the first label section 20 captured but the side images 21-24 are pressed into smooth contact with the respective faces of the base 110. As described below, this sliding action of the cage 200 over the first label section 20 and the base 110 allows for template 10 to be used and provides an easier way for the user to display five images around a cube without having to use adhesives to secure the images to the underlying structure (base 110). Adhesives can mar the images by leaving residue and also may permanently bind the images to the base 110 which limits the ability of the user to readily change the images that are displayed.

The cage 200 is rigid structure formed of a suitable material, such as a suitable plastic.

Figure 17:
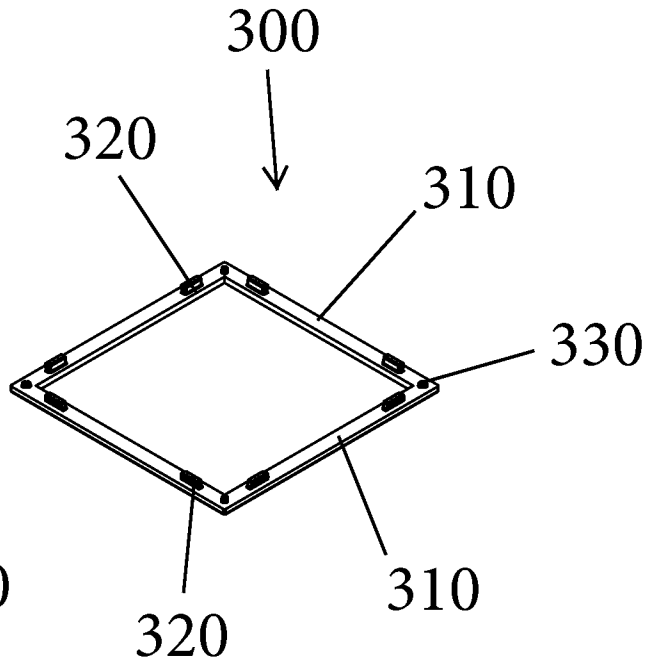
FIG. 17 is a top perspective view of a frame member of the cube-shaped display article of FIG. 1.
Figure 18:
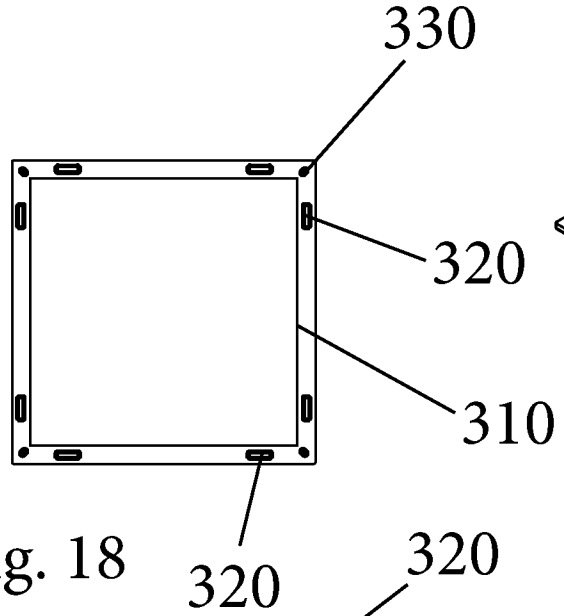
FIG. 18 is a top plan view thereof.
Figure 19:
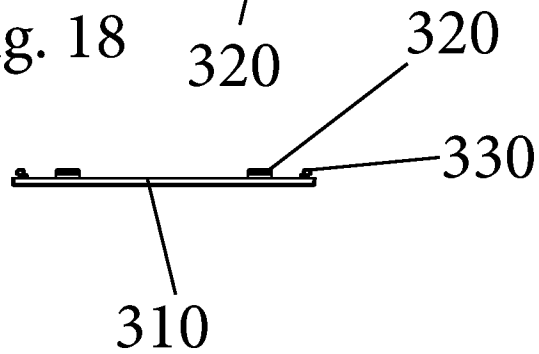
FIG. 19 is a side elevation view thereof.

Frame Member 300 (FIGS. 17-19)

The cube-shaped display article 100 also includes a frame member 300 that is intended to mate with and attach to the cage 200. The frame member 300 is itself a hollow frame member defined by a plurality of rails 310 that are connected to one another to form a hollow structure. The shape and size of the frame member 300 is complementary to the cage 200 since the frame member 300 mates to one face (i.e., a bottom face) of the cage 200. In the illustrated embodiment, the frame member 300 is square shaped which complements the cube shape of the cage 200. There are therefore four rails 310 to define the square shaped frame member 300.

The frame member 300 has a plurality of locking tabs 320 that engage and are received into the locking recesses 215 for attaching the frame member 300 to the cage 200. The locking tabs 320 are formed along the inner face of the frame member 300. Each locking tab 320 is in the form of an upstanding wall that has lip or locking flange formed at the top end of the upstanding wall. The lip extends outwardly away from the hollow center of the frame member 300.

The locking tabs 320 are intended to be received into the notches 116 between the edges of the cap 120 and the cage 200 and more particularly, the locking tabs 320 are received and engage the locking recesses 215 formed in the cage 200. This action results in a snap-fit between the frame member 300 and the cage 200.

As described below, the frame member 300 is designed to capture the second label section 50 between the frame member 300 and the solid cap 120. In this way, the attachment of the frame member 300 to the cage 200 results in the second label section 50 being pressed against the solid cap 120 and held in place.

The frame member 300 also includes corner protrusions 330 which can be in the form of circular shaped protrusions that extend outwardly from the inner face of the frame member 300. The corner protrusions 330 act as guides and are received within the corner guide cutouts or notches 105 that are formed in each bottom corner of the base 110. The combination of the corner protrusions 330 and guide cutouts 105 act as a guide to assist the user to properly positioning and mating together the frame member 300 and the base 110.

The cube-shaped display article 100 thus has two sub-assemblies that use snap-fits (or similar mechanical attachment techniques) to form the assembled sub-assembly and the complete assembled cube-shaped display article 100. The first snap-fit is between the base 110 and the cap 120 and the second snap-fit is between the cage 200 and the frame member 300.

In one embodiment, the cube-shaped article 100 is a 3 inch×3 inch cube; however, other sizes are possible.

Figure 6:
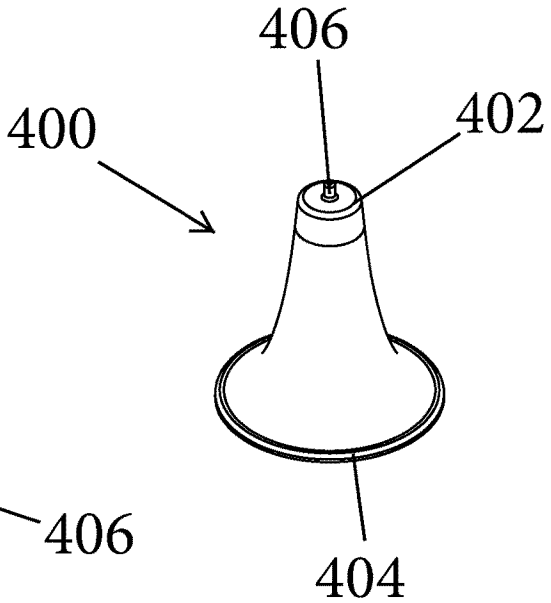
FIG. 6 is a perspective view of an optional stand for use with the cube-shaped display article of FIG. 1.
Figure 8:
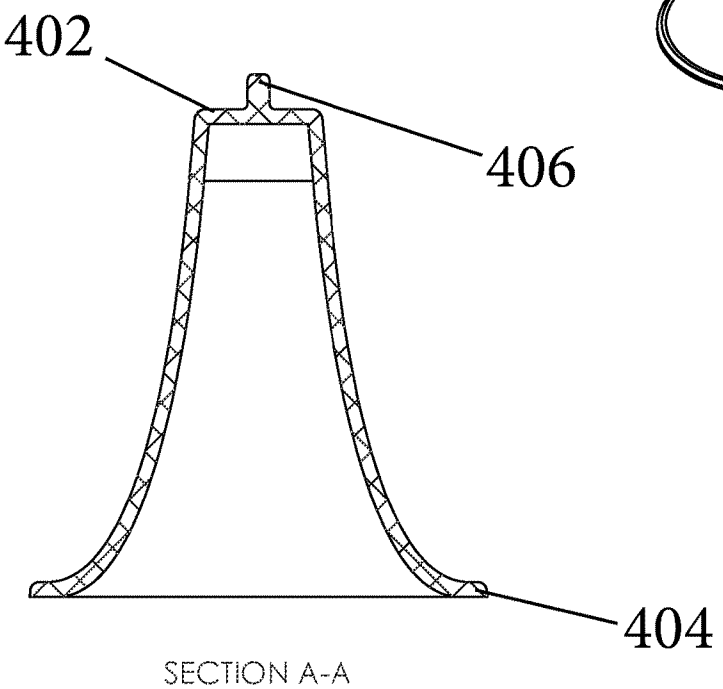
FIG. 8 is a cross-sectional view taken along the line A-A of FIG. 7.
Figure 7:
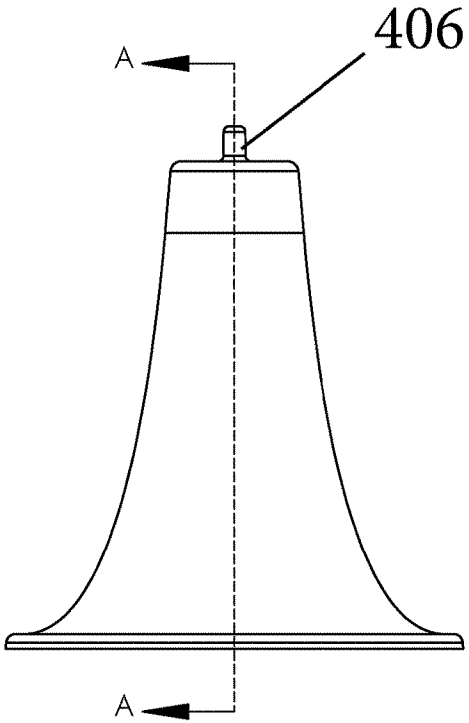
FIG. 7 is a side elevation view thereof.
Figure 9:
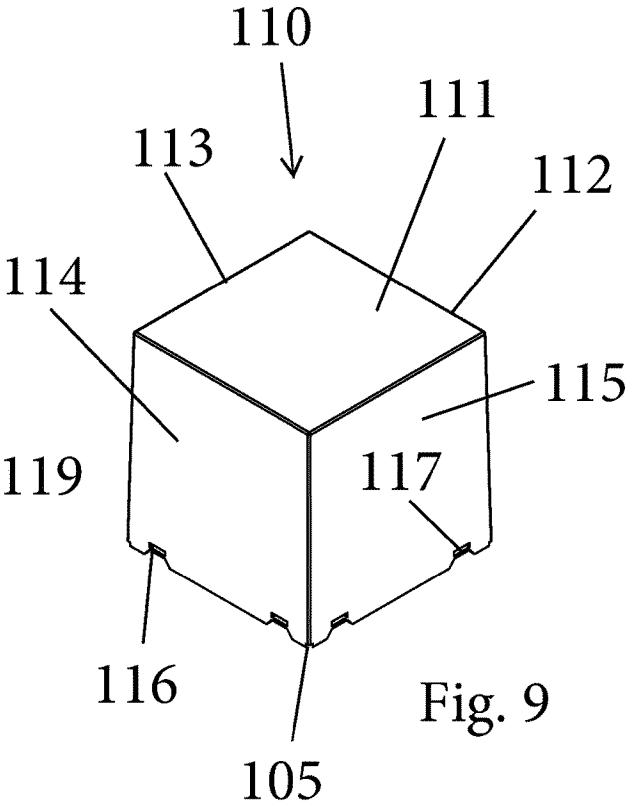
FIG. 9 is a perspective view of a base of the cube-shaped display article of FIG. 1.
Figure 11:
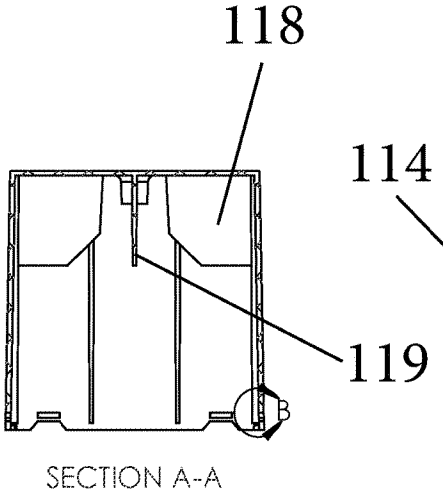
FIG. 11 is a cross-sectional view taken along the line A-A of FIG. 10.
Figure 12:
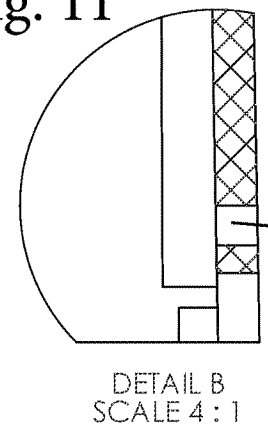
FIG. 12 is an enlarged portion of the base.
Figure 10:
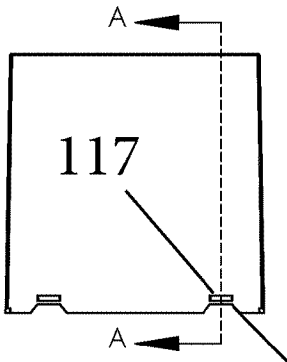
FIG. 10 is a side elevation view thereof.
Figure 13:
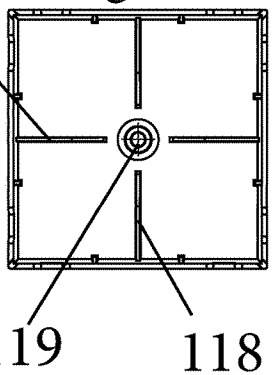
FIG. 13 is a bottom plan view.

Optional Stand (FIGS. 6-8)

In the event that the cube-shaped display article 100 is intended to be placed on a flat surface, such as a desk or table or shelf, a stand 400 (FIG. 6) can be provided. The stand 400 can be generally frustoconical shaped body (base portion) with a top end 402 and a bottom end 404 that is wider than the top end 402. The side wall of the stand 400 can be sloped. At the top end 402 there is a center protrusion 406 (post or nub) that extends upwardly from the flat top end 402. The center protrusion 406 is intended to be received within the center opening in the post 119 to couple the base 110 to the stand 400. The cap 120 is thus not used and the stand 400 is received within the hollow interior of the base 110. The second label section 50 is likewise not used in this embodiment. The display 100 can spin on the stand 400.

Assembly of the Display 100

The cube-shaped display article 100 can be assembled as follows.

The first label section 20 is placed over the base 110 with the image 25 being placed against the first face 111 of the base 110 and then the images 21-24 are folded about the perforated cut lines 40 to allow the images 21-24 to be folded downward and positioned against the other respective faces 112-115 of the base 110.

The user slowly guides the cage 200 over the first label section 20 and the base 110 causing the side images 21-24 to be pushed inward against the respective faces of the base 110. The purposeful tight fit between the outer cage 200 and the inner base 110 results in the first label section 20 being captured between the outer cage 200 and the inner base 110. At this time the sixth face of the base 110 remains fully open.

Next, the cap 120 is attached to the base 110 and more particularly, the cap 120 is positioned and pressed onto the base 110 such that each locking tab 122 snap-fittingly mates with one respective opening 117 to attach the cap 120 to the base 110.

The second label section 50 is then positioned over the outer surface of the cap 120.

To complete the assembly, the frame member 300 is then mated to the cage 200 such that the frame member 300 is placed over the second label section 50. When the frame member 300 snap-fits to the cage 200, the second label section 50 is captured.

When the stand 400 is used, the stand 400 is inserted into the hollow interior the base 110 and mates with the post 119 thereof and neither the cap 120 nor the frame member 300 are used.

When the stand 400 is not used, it will be appreciated that the cap 120 and the frame member 300 can be oriented as either the top or the bottom of the cube-shaped display article 100.

Alternative Cube-Shaped Display Article 500 (FIGS. 21-36)

FIGS. 21-36 illustrate another cube-shape display article 500 according to a second embodiment. The cube-shaped display article 500 shares many similarities with the cube-shaped display article 100 and therefore like elements are numbered alike. One difference is that the cube-shaped display article 500 can have a smaller footprint compared to the cube-shaped display article 100. For example, the cube-shaped display article 100 can be a 3×3 inch cube, while the cube-shaped display article 500 can be a 2×2 inch cube.

Base 510

The base 510 is similar to the base 110 and represents the structure to which the first label section 20 is applied. Accordingly, the base 510 is a five sided object that has the fives faces 111, 112, 113, 114, 115 that have complementary shapes and sizes relative to the five images 21-25 to allow the five images 21-25 (FIG. 20) to be applied to five faces 111-115 of the base 510.

As shown in FIGS. 22-26, the base 110 is a hollow structure that is open along its sixth face. In the illustrated embodiment, the base 110 is square shape and thus, each of the five faces 111-115 has a square shape. However, it will be appreciated that the size and/or shape of the base 110 can be altered and still be within the scope of the present disclosure. The first face 111 of the base 510 can be thought of as being a top or bottom of the base 110, with the second to five faces 112-115 being the sides of the base 510. At the exposed edges of each of the second to five faces 112-115, there is at least one notch 116 that is formed and open along the bottom edge. In addition, each of these faces 112-115 includes at least one opening 117 that is located immediately above one corresponding notch 116. In the illustrated embodiment, the openings 117 are rectangular shaped, the notch 116 is defined by angled side walls that taper inward toward the opening 117. It will be understood that the opening 117 and notch 116 can have other shapes as well. Since there are five faces 111-115, the base 510 has a total of four notches 116 and four openings 117.

As shown in FIGS. 9-13, the hollow inside of the base 510, there can be structural ribs (e.g., 4 ribs) 518 (which take a different form than the ribs 118) to provide for reinforcement of the base 510. There can be eight ribs 518 with each side wall having two ribs 518 formed therealong. The base 510 does not include the post 119 since the cube-shaped display article 500 is not intended to be used with the stand 400.

Figure 27:
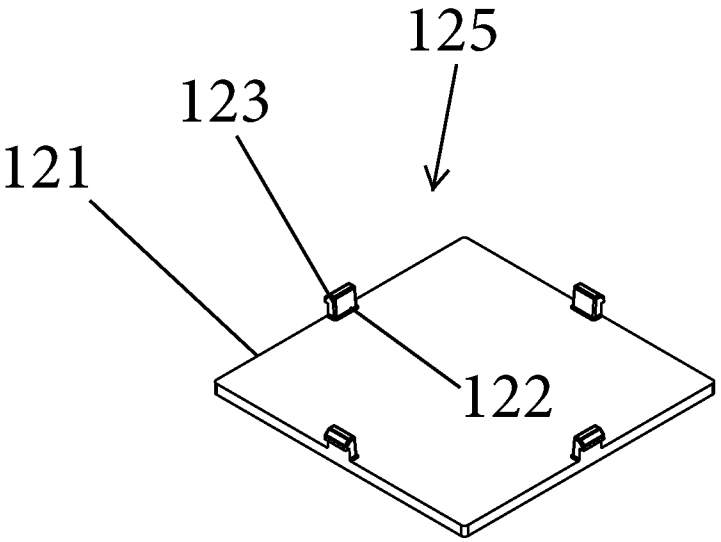
FIG. 27 is a perspective view of a cap of the cube-shaped display article of FIG. 21.
Figure 28:
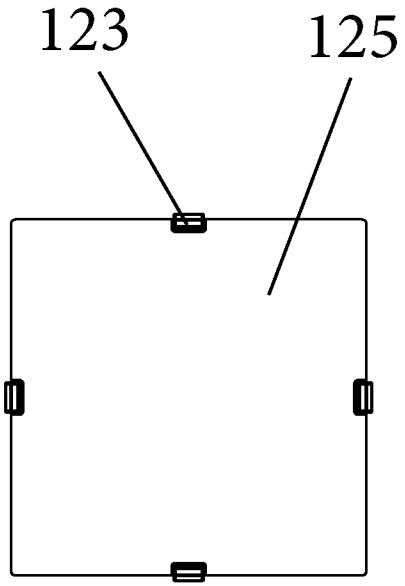
FIG. 28 is a bottom plan view of the cap.
Figure 29:
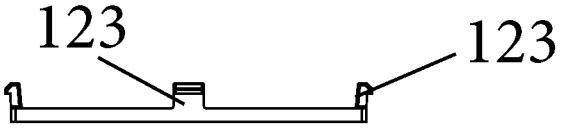
FIG. 29 is a side elevation view thereof.
Figure 30:
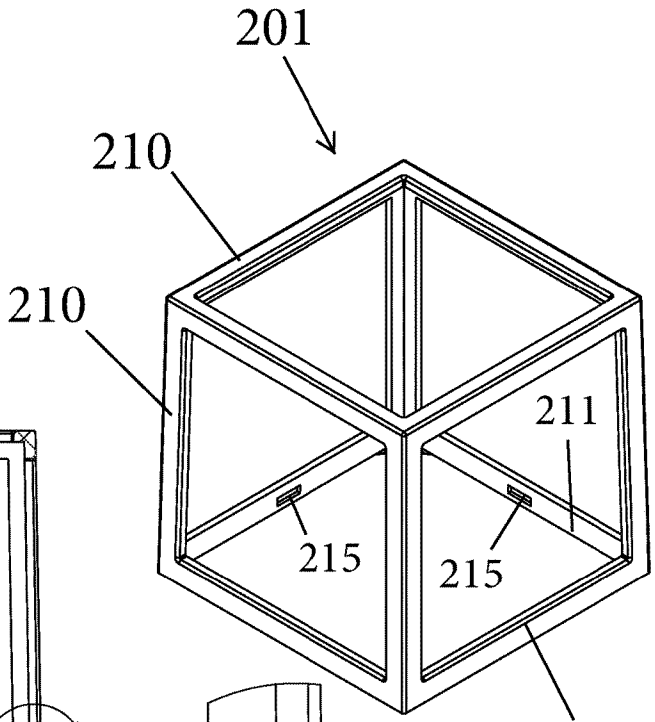
FIG. 30 is a perspective view of a cage of the cube-shaped display article of FIG. 21.

Cap 125 (FIGS. 27-29)

The cap 125 is very similar to the cap 120 with the one difference being that the illustrated cap 125 includes only one locking tabs 122 along each side edge 121. Each locking tab 122 is designed to mate with one respective opening 117 to attach the cap 125 to the base 510. Once the cap 125 is attached to the base 510, the resulting structure is a complete cube with a hollow interior. This attachment is intended to be of a permanent nature. It will be appreciated that the cap 125 can include two locking tabs 122 instead of one along each side edge 121 as in cap 120.

Cage 201 (FIGS. 30-33)

The cage 201 is very similar to the cap 200 with the one difference being that the illustrated cage 201 includes only one locking recess 115 along each side edge. It will be appreciated that the cage 201 can include two locking recesses 115 along each side instead of one along each side edge as in cage 201.

Figure 34:
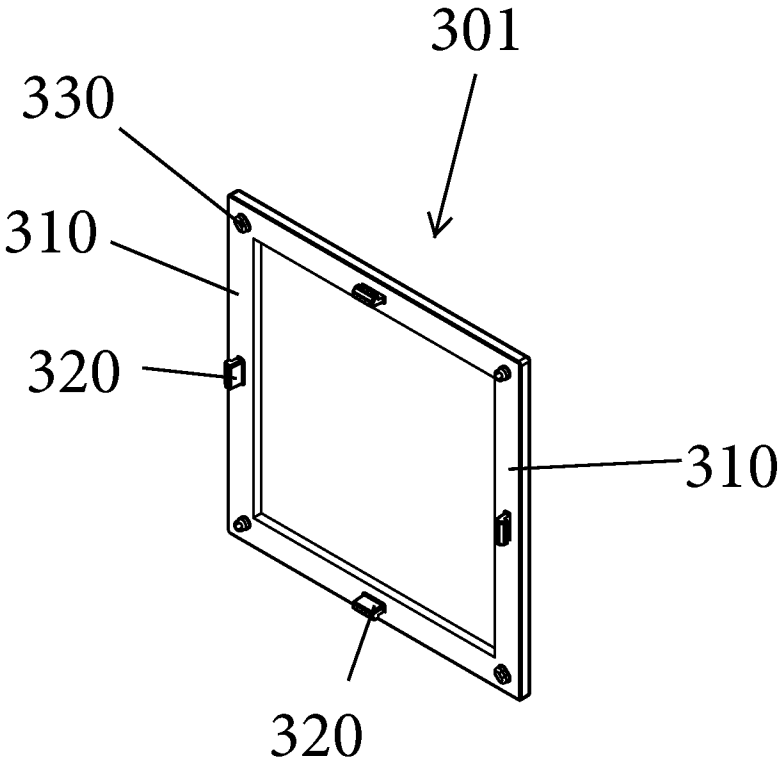
FIG. 34 is a perspective view of a frame member of the cube-shaped display article of FIG. 21.
Figure 35:
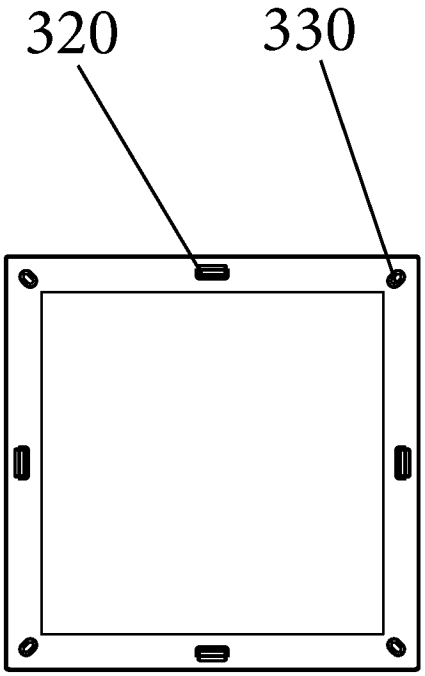
FIG. 35 is a top plan view thereof.
Figure 36:
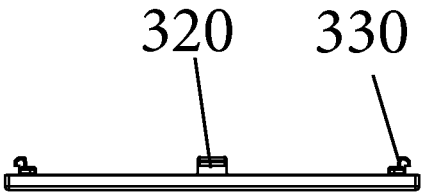
FIG. 36 is a side elevation view thereof.

Frame Member 301 (FIGS. 34-36)

The frame member 301 is very similar to the frame member 300 with the one difference being that the illustrated frame member 301 includes only one locking tab 320 along each side rail 310. However, like frame member 300, each corner includes one corner protrusion 330, It will be appreciated that the frame member 301 can include two locking tabs 320 along each rail 310 as in frame member 300.

One difference between the cube-shaped display article 100 and the cube-shaped display article 500 is that the cube-shaped display article 500 is constructed so that it can be hung as an ornament.

Figure 33:
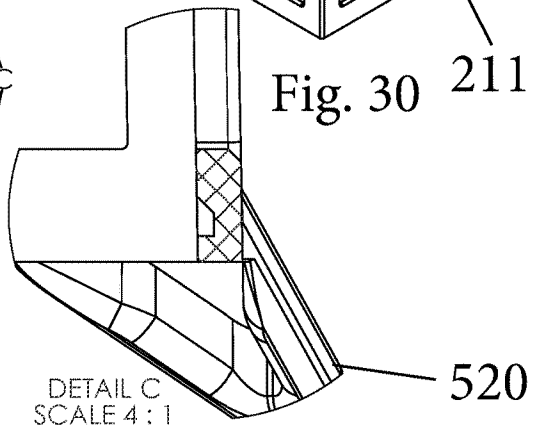
FIG. 33 is an enlarged portion thereof.
Figure 32:
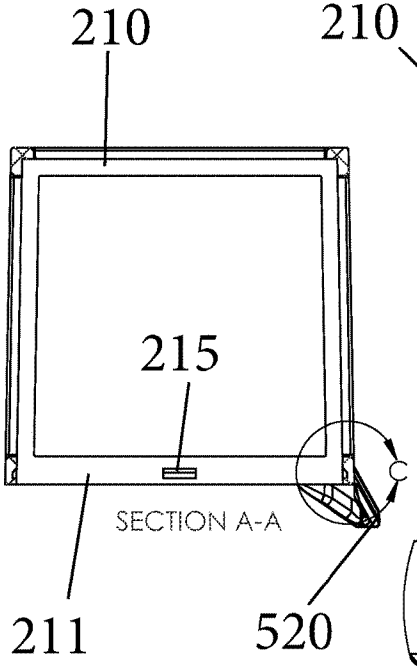
FIG. 32 is a cross-sectional view taken along the line A-A of FIG. 31.
Figure 31:
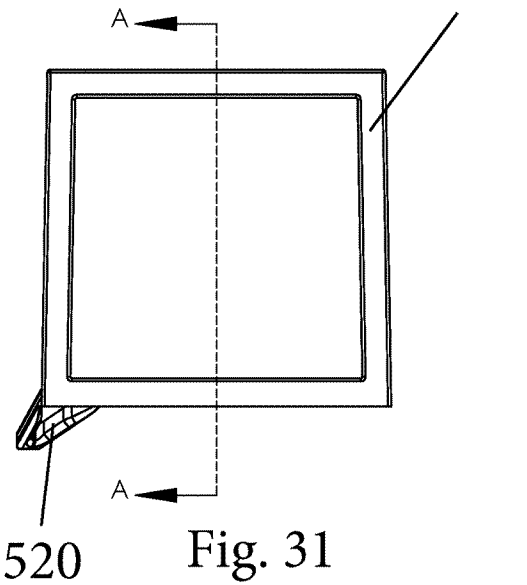
FIG. 31 is a top plan view thereof.

Hang Loop 520 (FIGS. 31-33)

The cage 201 that is part of the cube-shaped display article 500 a hang loop 520 that is formed in one of the upper corners of the cage 201. In all other ways, except size, the cage 201 for the cube-shaped display article 500 is the same for the cube-shaped display article 100. This hang loop 520 is preferably an integral structure that defines a loop in the one corner of the cage. The hang loop 520 can be formed of the same material as the cage 201. Like most ornaments, the hang loop 520 can be used to hang the cube-shaped display article 100 as by a hook or string, etc.

Assembly of the Display 500

The cube-shaped display article 500 can be assembled as follows.

The first label section 20 is placed over the base 510 with the image 25 being placed against the first face 111 of the base 510 and then the images 21-24 are folded about the perforated cut lines 40 to allow the images 21-24 (FIG. 20) to be folded downward and positioned against the other respective faces 112-115 of the base 510.

The user slowly guides the cage 201 over the first label section 20 and the base 510 causing the side images 21-24 to be pushed inward against the respective faces of the base 510. The purposeful tight fit between the outer cage 201 and the inner base 510 results in the first label section 20 being captured between the outer cage 201 and the inner base 510. At this time the sixth face of the base 510 remains fully open.

Next, the cap 125 is attached to the base 510 and more particularly, the cap 125 is positioned and pressed onto the base 510 such that each locking tab 122 snap-fittingly mates with one respective opening 117 to attach the cap 125 to the base 510.

The second label section 50 is then positioned over the outer surface of the cap 125.

To complete the assembly, the frame member 301 is then mated to the cage 201 such that the frame member 301 is placed over the second label section 50. When the frame member 301 snap-fits to the cage 201, the second label section 50 is captured.

The hang loop 520 permits the cube-shaped display article 500 to be hung.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A cube-shaped display article comprising:

an inner cube-shaped base;

a first image substrate comprising a plurality of individual image sections that are arranged in a first pattern, each individual image section for displaying content, the first image substrate having a plurality of crease lines to permit folding of the first image substrate for positioning the individual image sections against corresponding faces of the inner cube-shaped base; and an outer hollow cube-shaped cage for placement over the inner cube-shaped base, the outer hollow cube-shaped cage capturing the first image substrate which is located between the outer hollow cube-shaped cage and the inner cube-shaped base and serving to press the individual images against the corresponding faces of the inner cube-shaped base, the outer hollow cube-shaped cage having six open spaces defined by a frame of the outer hollow cube-shaped cage for displaying the individual image sections through five of the six open spaces;

a second image substrate comprising one individual image section, the second image substrate being separate and detached from the first image substrate;

a hollow frame member that includes locking tabs for reception within locking recesses of the outer hollow cube-shaped cage to establish a snap-fit therebetween, the second image substrate being captured between the inner cube-shaped base and the hollow frame member and displayed through an open space defined by a frame of the hollow frame member.

2. The cube-shaped display article of claim 1, wherein the inner cube-shaped base comprises a five sided structure and the corresponding faces comprise a first face, a second face, a third face, a fourth face, and a fifth face, the five-sided structure having a hollow interior.

3. The cube-shaped display article of claim 2, wherein each of the second face, third face, fourth face and the fifth face includes a free edge with at least one opening being formed along each face proximate but spaced inwardly from the free edge.

4. The cube-shaped display article of claim 3, where each of the second face, third face, fourth face and the fifth face includes two openings as well as a pair of notches that are open along the free edge, wherein each notch is formed adjacent a corresponding opening and further including a cap that snap-fittingly attaches to an open face of the five-sided structure to complete and close off the five-sided structure so as to define a six-sided cube, the cap including a plurality of locking tabs that mate with and engage the openings formed in the second face, the third face, the fourth face and the fifth face.

5. The cube-shaped display article of claim 2, further including a cap that snap-fittingly attaches to an open face of the five-sided structure to complete and close off the five-sided structure so as to define a six-sided cube.

6. The cube-shaped display article of claim 5, wherein the cap comprises a square-shaped plate.

7. The cube-shaped display article of claim 6, wherein the first image section is disposed over the first face, the second image section is disposed over the second face, the third image section is disposed over the third face, the fourth image section is disposed over the fourth face, and the fifth image section is disposed over the fifth face.

8. The cube-shaped display article of claim 2, wherein the individual images section of the first image substrate are arranged in a cross shape and defined by a first image section arranged in the center and a second image section, a third image section, a fourth image section and a fifth image section arranged about and separated from the first image section by a fold line.

9. The cube-shaped display article of claim 2, further including a stand that has a base portion and an upstanding protrusion that is received with an opening formed in a post formed within the hollow interior of inner cube-shaped base for supporting the cube-shaped display article on the stand in a rotatable manner.

10. The cube-shaped display article of claim 1, wherein the first image substrate is formed of a label stock and is not positively adhered to the corresponding faces of the inner cube-shaped base but rather the outer hollow cube-shaped cage retains the first image substrate in place against the inner cube-shaped base.

11. The cube-shaped display article of claim 1, wherein the outer hollow cube-shaped cage includes an integral hang loop for hanging the cube-shaped display article.

12. The cube-shaped display article of claim 11, wherein the hang loop is located in a top corner of the outer hollow cube-shaped cage.

13. The cube-shaped display article of claim 1, wherein the inner cube-shaped base comprises two parts that are snap-fit together.

14. A cube-shaped display article comprising:

an inner cube-shaped base;

a first image substrate comprising a plurality of individual image sections that are arranged in a first pattern, each individual image section for displaying content, the first image substrate having a plurality of crease lines to permit folding of the first image substrate for positioning the individual image sections against corresponding faces of the inner cube-shaped base; and an outer hollow cube-shaped cage for placement over the inner cube-shaped base, the outer hollow cube-shaped cage capturing the first image substrate which is located between the outer hollow cube-shaped cage and the inner cube-shaped base and serving to press the individual images against the corresponding faces of the inner cube-shaped base;

wherein the outer hollow cube-shaped cage comprises a plurality of first rails arranged and connected at their ends to form the outer hollow cube-shaped cage, wherein a set of end rails that form part of the plurality of rails each includes one or more locking recesses.

15. The cube-shaped display article of claim 14, wherein the set of end rails defines one end of the outer hollow cube-shaped cage.

16. The cube-shaped display article of claim 14, further including a hollow frame member that includes locking tabs for reception within the locking recesses of the outer hollow cube-shaped cage to establish a snap-fit therebetween.

17. The cube-shaped display article of claim 16, wherein the hollow frame member comprises a plurality of interconnected second rails, each second rail including at least one locking tab and in corners of the hollow frame member there are guide protrusions that are received within guide notches formed in corners of the inner cube-shaped base for locating the hollow frame member relative to the inner cube-shaped base.

18. The cube-shaped display article of claim 16, further including a second image substrate comprising one individual image section, the second image substrate for placement and capture between the inner cube-shaped base and the hollow frame member.

19. A cube-shaped display article comprising:

an inner cube-shaped base;

a first image substrate comprising a five individual image sections that are arranged in a cross-shaped pattern, the first image substrate having a plurality of crease lines to permit folding of the first image substrate for positioning the five individual images sections against five corresponding faces of the inner cube-shaped base;

an outer hollow cube-shaped cage configured to slide over and surround the inner cube-shaped base, the outer hollow cube-shaped cage capturing the first image substrate at a location between the outer hollow cube-shaped cage and the inner cube-shaped base, the outer hollow cube-shaped cage being formed of a plurality of rails that are interconnected at their ends to form the outer hollow cube-shaped cage, the plurality of rails defining a border around each of the five individual image sections; and a frame member configured to snap-fit to the outer hollow cube-shaped cage for positioning and retaining a second image substrate against a sixth face of the inner cube-shaped base.

20. A method for constructing a cube-shaped display article comprising the steps of:

disposing a first image substrate over an inner cube-shaped base, the first image substrate comprising a plurality of individual image sections that are arranged in a first pattern and on which an image can be formed, the first image substrate having a plurality of crease lines;

folding the first image substrate about the crease lines to position the individual images against corresponding faces of the inner cube-shaped base;

sliding an outer hollow cube-shaped cage over both the folded first image substrate and the inner cube-shaped base resulting in the capturing of the first image substrate between the outer hollow cube-shaped cage and the inner cube-shaped base and resulting in the individual images being pressed against the corresponding faces of the inner cube-shaped base;

disposing a second image substrate over one face of the inner cube-shaped base, the second image substrate comprising one individual image section; and attaching a hollow frame member to the outer hollow cube-shaped cage, the second image substrate being captured between the inner cube-shaped base and the hollow frame member.

* * * * *